US012234641B2

(12) United States Patent
Jiang et al.

(10) Patent No.: US 12,234,641 B2
(45) Date of Patent: Feb. 25, 2025

(54) RETRACTABLE ANGLED ROOF FOR FAST INSTALLATION AND SHIPMENT

(71) Applicant: A&C FUTURE, INC., Newport Beach, CA (US)

(72) Inventors: Xunmin Jiang, Irvine, CA (US); Jiuqi Wang, Santa Ana, CA (US); Zhuangboyu Zhou, Santa Ana, CA (US); Sichen Li, Santa Ana, CA (US); Ju Gao, Newport Beach, CA (US); Han Qin, Newport Beach, CA (US); Jiayang Qin, Newport Beach, CA (US)

(73) Assignee: A&CFUTURE, INC., Newport Beach, CA (US)

( * ) Notice: Subject to any disclaimer, the term of this patent is extended or adjusted under 35 U.S.C. 154(b) by 170 days.

(21) Appl. No.: 17/937,727

(22) Filed: Oct. 3, 2022

(65) Prior Publication Data

US 2024/0110377 A1 Apr. 4, 2024

(51) Int. Cl.

| | |
|---|---|
| ***E04B 7/16*** | (2006.01) |
| ***E04B 1/344*** | (2006.01) |
| ***E04C 3/04*** | (2006.01) |
| ***E04C 3/11*** | (2006.01) |

(52) U.S. Cl.

CPC ..... *E04B 7/163* (2013.01); *E04B 7/166* (2013.01); *E04B 1/344* (2013.01); *E04C 2003/0491* (2013.01); *E04C 3/11* (2013.01)

(58) Field of Classification Search

CPC ..... E04B 7/163; E04B 7/166; E04B 1/344; E04C 3/11; E04C 2003/0491

USPC ..... 52/79.5, 645

See application file for complete search history.

(56) References Cited

U.S. PATENT DOCUMENTS

| | | | | |
|---|---|---|---|---|
| 3,774,356 | A * | 11/1973 | Philp | E04C 3/40 52/70 |
| 3,785,108 | A * | 1/1974 | Satchell | E04C 3/11 52/645 |
| 4,027,912 | A | 6/1977 | Pacca | |
| 6,634,152 | B1 * | 10/2003 | Pilkinton | E04C 3/07 52/645 |
| 6,763,633 | B2 * | 7/2004 | Cote | E04B 1/344 52/79.5 |
| 7,243,464 | B1 * | 7/2007 | Crowell | E04D 3/08 52/471 |
| 7,832,151 | B2 | 11/2010 | Harrisson et al. | |
| 8,056,573 | B2 * | 11/2011 | Panigot | E04H 15/48 135/147 |
| 8,800,214 | B2 | 8/2014 | Silberman et al. | |

(Continued)

*Primary Examiner* — Omar F Hijaz

(74) *Attorney, Agent, or Firm* — INNOVATION CAPITAL LAW GROUP, LLP; Vic Lin

(57) ABSTRACT

A retractable roof construction can be manufactured in a factory and quickly deployed when assembling the house. The retractable roof can be made in parts and assembled into its compact formation whilst in the factory. This compact formation reduces space occupied in shipment, reducing the overall cost. When the compact formation roof is on a construction site, the roof can expand on both sides and be raised in the middle to provide an angle to protect against the rain. The expending process can be automated for reducing labor used in the construction. When compared to traditional roof construction, the retractable roof construction allows fast installation as well as reduced cost, both in shipping and labor.

17 Claims, 13 Drawing Sheets

(56) References Cited

U.S. PATENT DOCUMENTS

| | | | | |
|---|---|---|---|---|
| 9,145,732 | B2 | 9/2015 | Frigerio | |
| 9,593,503 | B2 | 3/2017 | Creagh | |
| 11,015,349 | B2 | 5/2021 | Byszenski et al. | |
| 11,319,703 | B2 * | 5/2022 | Nakagawa | E04B 1/58 |
| 11,641,176 | B2 * | 5/2023 | Lalane | H02S 20/10 52/173.3 |
| 2007/0113488 | A1 * | 5/2007 | Wilson | E04B 1/344 52/79.5 |
| 2008/0083189 | A1 * | 4/2008 | Dulac | E04B 1/3445 52/79.5 |
| 2009/0013614 | A1 | 1/2009 | Rogers | |
| 2021/0189717 | A1 * | 6/2021 | Nakagawa | E04B 7/02 |
| 2022/0274519 | A1 | 9/2022 | Mackay | |

* cited by examiner

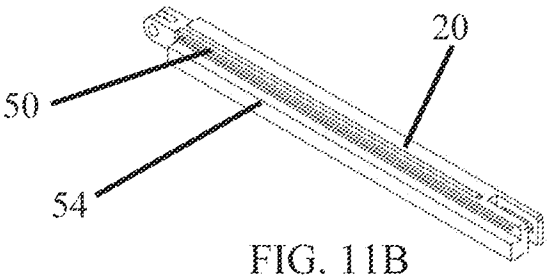
FIG. 11B
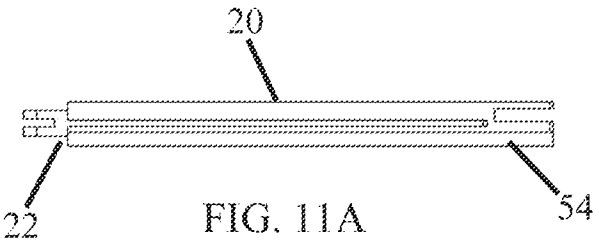
FIG. 11A
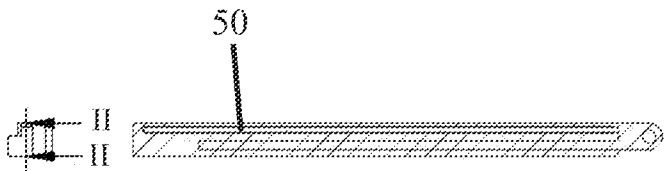
FIG. 11F
FIG. 11E
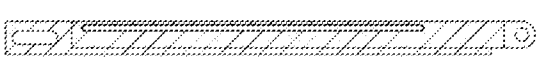
FIG. 11G
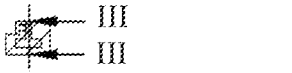
FIG. 11D
FIG. 11H
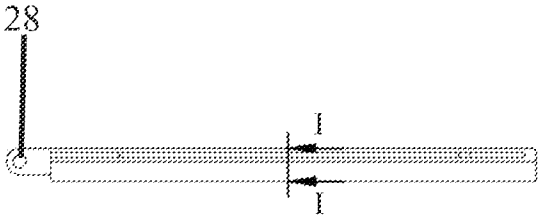
FIG. 11C

RETRACTABLE ANGLED ROOF FOR FAST INSTALLATION AND SHIPMENT

BACKGROUND OF THE INVENTION

1. Field of the Invention

Embodiments of the invention relate generally to roof construction. More particularly, embodiments of the invention relate to a retractable angled roof that can be quickly installed and shipped in a compact form.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Traditional house construction requires workers to spend a few days building a roof on the frame of the house. This can not only be time consuming, but costly, as such construction is often specialized and requires a skilled roofing working. While a truss roof construction may allow for assembly of individual framework off-site, truss roof construction requires labor for sheeting the roof and also requires significant space for shipping the pre-assembled structures.

In view of the foregoing, there is a need for a roof construction that can be shipped in a reduced size configuration and can be quickly and easily deployed on a structure.

SUMMARY OF THE INVENTION

Embodiments of the present invention provide a retractable roof comprising a first frame on a first side of the retractable roof; a second frame on the second side of the retractable roof; a plurality of roof boards spanning between the first frame and the second frame; wherein the first and second frames include a vertical riser having a top end and a lower end; opposing first and second angled arms pivotably extending from opposite sides of the top end of the vertical riser; a horizontal arm slidably disposed on the vertical riser; horizontal telescoping arms extendable from opposite ends of the horizontal arm, the horizontal telescoping arms extendable to span at least a width of a structure on which the retractable roof is applied; and telescoping arms extending from each of the first and second angled arms, the telescoping arms pivotably attached to respective ends of the horizontal telescoping arms, wherein the horizontal arm is movable from a first position defining a collapsed configuration and a second position defining an extended configuration, wherein, in the first position, the horizontal arm is disposed closer to both of the first and second angled arms.

Embodiments of the present invention provide a retractable roof comprising a first frame on a first side of the retractable roof; a second frame on the second side of the retractable roof; a plurality of roof boards spanning between the first frame and the second frame; wherein the first and second frames include a vertical riser having a top end and a lower end; opposing first and second angled arms pivotably extending from opposite sides of the top end of the vertical riser; a horizontal arm slidably disposed on the vertical riser; horizontal telescoping arms extendable from opposite ends of the horizontal arm, the horizontal telescoping arms extendable to span at least a width of a structure on which the retractable roof is applied; and telescoping arms extending from each of the first and second angled arms, the telescoping arms pivotably attached to respective ends of the horizontal telescoping arms, wherein the telescoping arms include a telescoping arm slot directing travel of a first portion of the plurality of roof boards; the angled arms include an angled arm slot directing travel of a second portion of the plurality of roof boards; and each of the first and second portions of roof boards include a roller on opposing sides thereof, the roller fitting into one of the telescoping arm slot or the angled arm slot.

Embodiments of the present invention provide a retractable roof comprising a first frame on a first side of the retractable roof; a second frame on the second side of the retractable roof; a plurality of roof boards spanning between the first frame and the second frame; wherein the first and second frames include a vertical riser having a top end and a lower end; opposing first and second angled arms pivotably extending from opposite sides of the top end of the vertical riser; a horizontal arm slidably disposed on the vertical riser; horizontal telescoping arms extendable from opposite ends of the horizontal arm, the horizontal telescoping arms extendable to span at least a width of a structure on which the retractable roof is applied; telescoping arms extending from each of the first and second angled arms, the telescoping arms pivotably attached to respective ends of the horizontal telescoping arms; and a double pivot connector connecting the telescoping arms to the respective ends of the horizontal telescoping arms, wherein the horizontal arm is movable from a first position defining a collapsed configuration and a second position defining an extended configuration, wherein, in the first position, the horizontal arm is disposed closer to both of the first and second angled arms; in the first position, the horizontal arms are generally parallel to the first and second angled arms; the telescoping arms include a telescoping arm slot directing travel of a first portion of the plurality of roof boards; and the angled arms include an angled arm slot directing travel of a second portion of the plurality of roof boards.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

FIG. 11A illustrates a top view of an upper beam assembly, in a collapsed configuration, of the retractable roof of FIG. 1A;

FIG. 11B illustrates a perspective view of the upper beam assembly of FIG. 11A;

FIG. 11C illustrates a front view of the upper beam assembly of FIG. 11A;

FIG. 11D illustrates a cross-sectional view taken along line I-I of FIG. 11C;

FIG. 11E illustrates an end view of the upper beam assembly of FIG. 11A;

FIG. 11F illustrates a cross-sectional view taken along line II-II of FIG. 11E;

FIG. 11G illustrates a cross-sectional view taken along line III-III of FIG. 11D;

FIG. 11H illustrates an end view of the upper beam assembly of FIG. 11A;

Figure 1B:
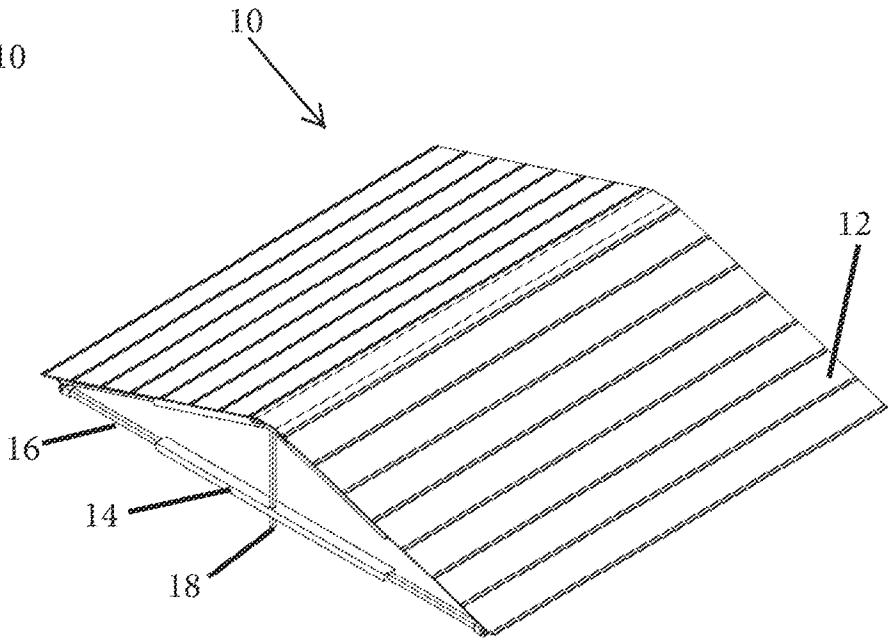
FIG. 1B illustrates a perspective view of the retractable roof of FIG. 1A.
Figure 1D:
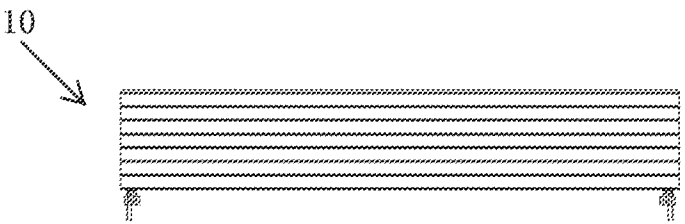
FIG. 1D illustrates a side view of the retractable roof of FIG. 1A.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a retractable roof construction that can be manufactured in a factory and quickly deployed when assembling the house. This retractable roof can be made in parts and assembled into its compact formation whilst in the factory. This compact formation reduces space occupied in shipment, reducing the overall cost. When the compact formation roof is on a construction site, the roof can expand on both sides and be raised in the middle to provide an angle to protect against the rain. The expending process can be automated for reducing labor used in the construction. When compared to traditional roof construction, the retractable roof construction allows fast installation as well as reduced cost, both in shipping and labor.

Referring to FIGS. 1A through 2D, a retractable roof 10 is shown in its expanded configuration which can be fitted to a house. Such a structure can be connected to the house by various techniques known in the art, such as clips, ties, fasteners or the like.

Figure 8B:
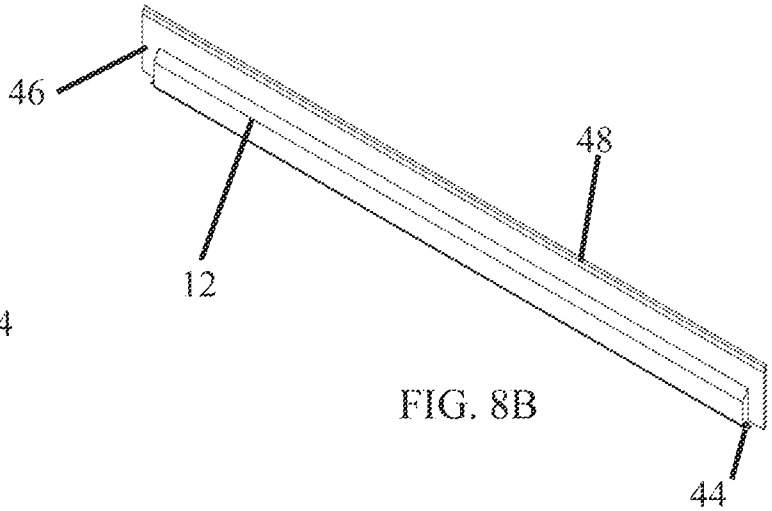
FIG. 8B illustrates a perspective view of the roof board of FIG. 8A.
Figure 8A:
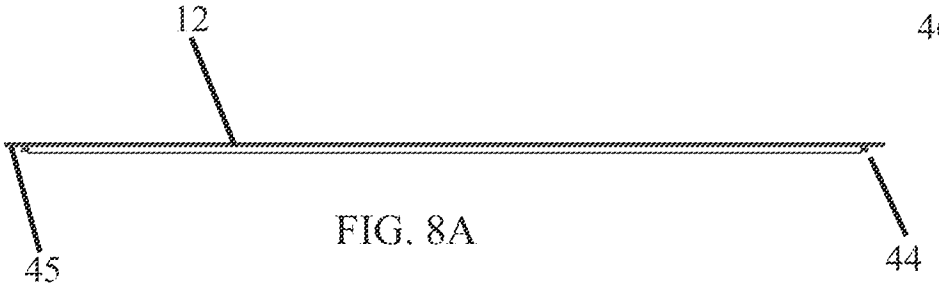
FIG. 8A illustrates a top view of a roof board having a long shaft, usable in the retractable roof of FIG. 1A.
Figure 8E:
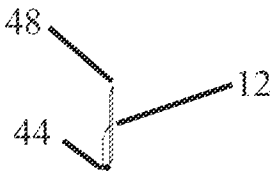
FIG. 8E illustrates an end view of the roof board of FIG. 8A.
Figure 8D:
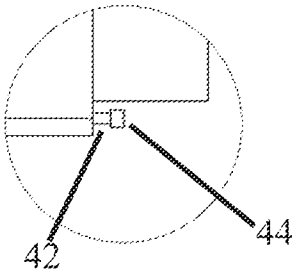
FIG. 8D illustrates a close-up view of an end of the long shaft of the roof board of FIG. 8A.
Figure 8C:
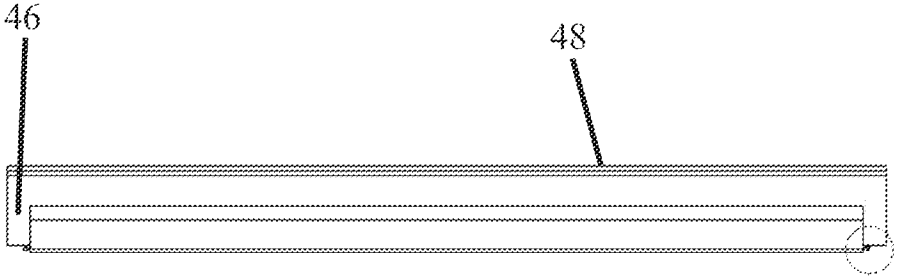
FIG. 8C illustrates a front view of the roof board of FIG. 8A.
Figure 9B:
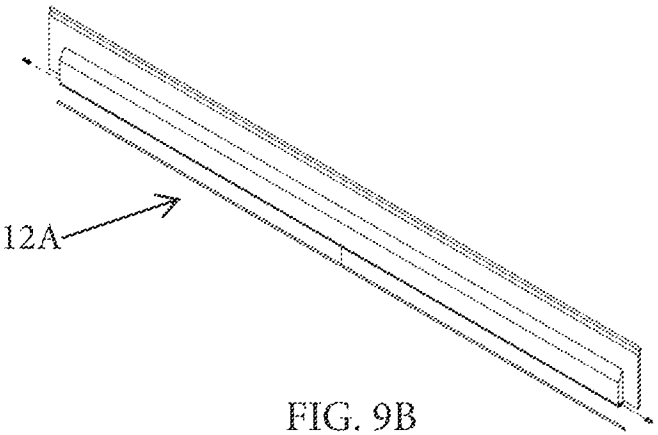
FIG. 9B illustrates an exploded perspective view of the roof board of FIG. 8A.
Figure 9A:
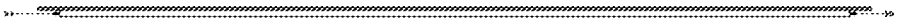
FIG. 9A illustrates an exploded top view of a roof board having a long shaft, usable in the retractable roof of FIG. 1A.
Figure 9C:
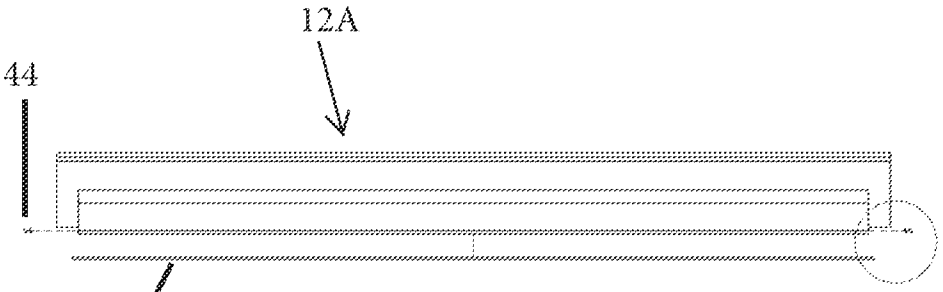
FIG. 9C illustrates an exploded front view of the roof board of FIG. 8A.
Figure 9E:
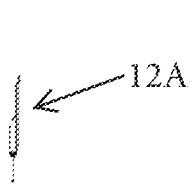
FIG. 9E illustrates an exploded end view of the roof board of FIG. 8A.
Figure 9D:
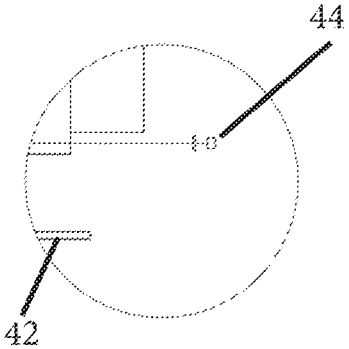
FIG. 9D illustrates an exploded close-up view of an end of the long shaft of the roof board of FIG. 8A.
Figure 10B:
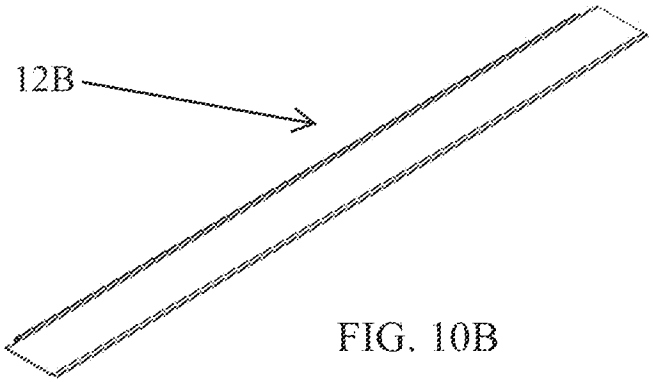
FIG. 10B illustrates a perspective view of the roof board of FIG. 10A.
Figure 10A:
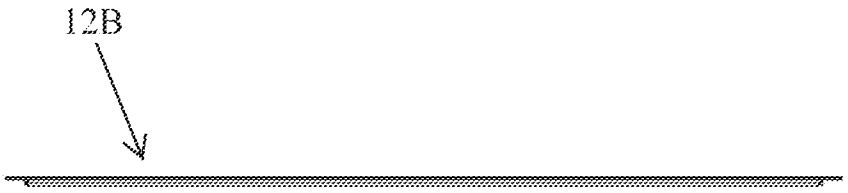
FIG. 10A illustrates a top view of a roof board having a long shaft, usable in the retractable roof of FIG. 1A.
Figure 10C:
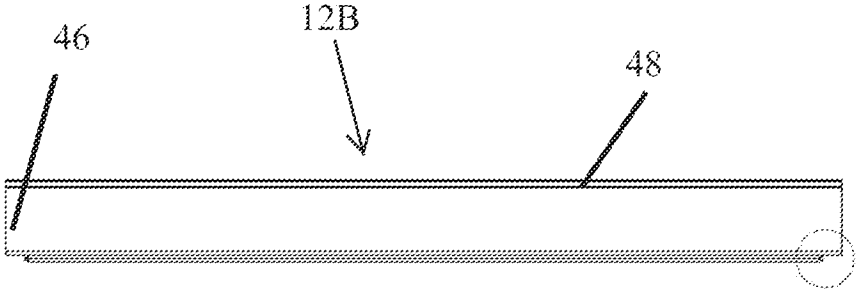
FIG. 10C illustrates a front view of the roof board of FIG. 10A.
Figure 10D:
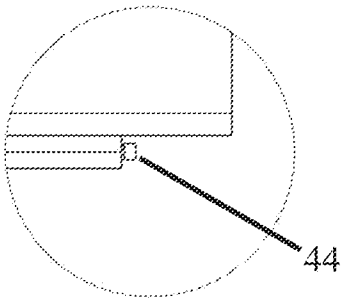
FIG. 10D illustrates a close-up view of an end of the long shaft of the roof board of FIG. 10A.
Figure 10E:
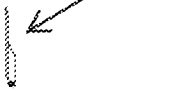
FIG. 10E illustrates an end view of the roof board of FIG. 10A.
Figure 12B:
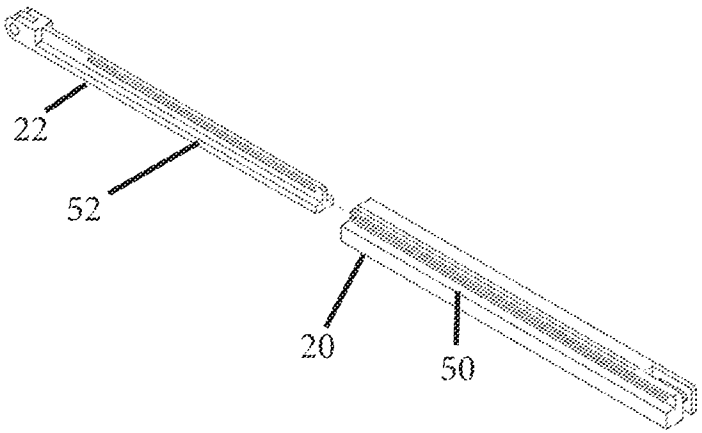
FIG. 12B illustrates an exploded perspective view of the upper beam assembly of FIG. 11A.
Figure 12D:
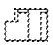
FIG. 12D illustrates an end view of the upper beam assembly of FIG. 11A.
Figure 12A:
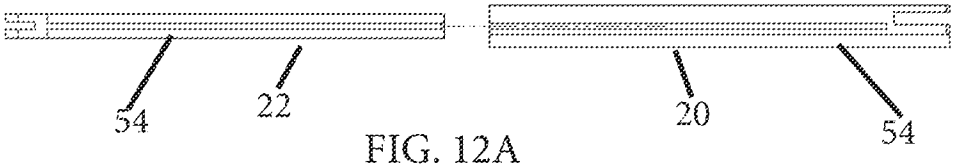
FIG. 12A illustrates an exploded top view of the upper beam assembly of FIG. 11A.
Figure 12C:
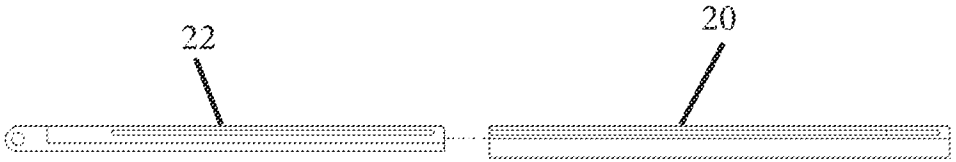
FIG. 12C illustrates an exploded front view of the upper beam assembly of FIG. 11A.
Figure 13B:
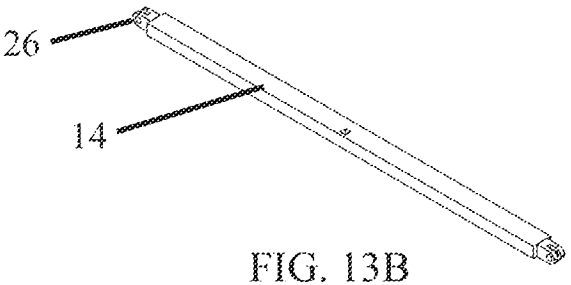
FIG. 13B illustrates a perspective view of the lower horizontal beam of FIG. 13A.
Figure 13D:
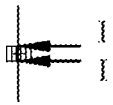
FIG. 13D illustrates an end view of the lower horizontal beam of FIG. 13A.
Figure 13E:
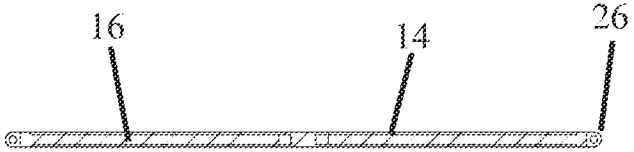
FIG. 13E illustrates a cross-sectional view taken along line I-I of FIG. 13D.
Figure 13A:
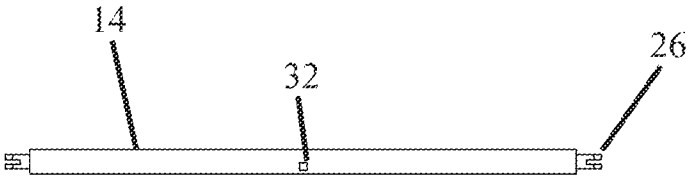
FIG. 13A illustrates a top view of a lower horizontal beam, in a collapsed configuration, of the retractable roof of FIG. 1A.
Figure 13C:
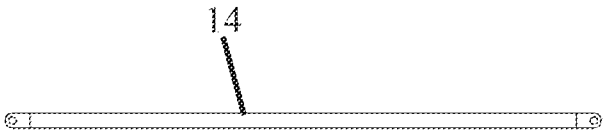
FIG. 13C illustrates a front view of the lower horizontal beam of FIG. 13A.

The retractable roof can include two roof frame assemblies 40 on each side and roof boards 12 spanning between the two roof frame assemblies 40. The roof boards 12 can include a small forward overhang 48 (see FIG. 8B, for example) on where they touch the next roof board. The roof boards 12 can include side overhangs 46 (see FIG. 8C, for example) on the side to prevent water from leaking in, as discussed in greater detail below. The roof boards 12 can be constrained onto the two roof frame assemblies by rollers and rails and can move along the rail for a set distance, as described below. This distance is determined by the width of the boards as all boards should fit tightly next to each other without space.

The retractable roof 10 can include a vertical riser 18 where the angled arms 20 are pivotably attached to extend in opposite directions from the top of the vertical riser 18. A telescoping member 22 can telescopingly extend from each of the angled arms 20. An end 28 of the angled arms may pivotably connect to a telescoping member 16 that is telescopingly extendable from each end of a horizontal arm 16. In the extended configuration, as illustrated in FIGS. 1A through 2D, the horizontal arm 16 may be positioned at or near the bottom of the vertical riser 18. As discussed below, the horizontal arm 16 may move vertically along the vertical riser 18 for converting the retractable roof 10 between the expanded configuration (FIGS. 1A through 2D) and the collapsed configuration (FIGS. 3A through 3D).

Figure 1A:
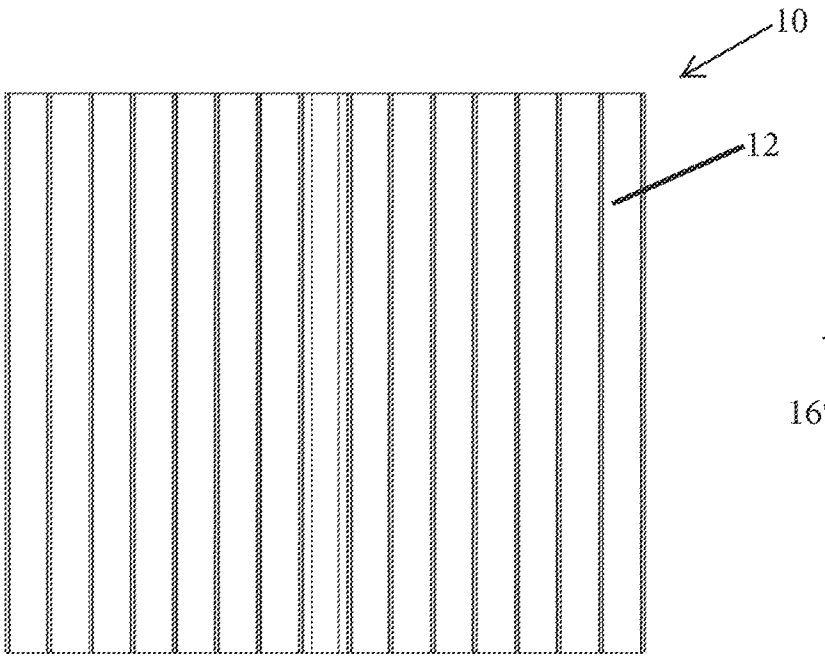
FIG. 1A illustrates a top view of a retractable roof in an expanded configuration according to an exemplary embodiment of the present invention.
Figure 1C:
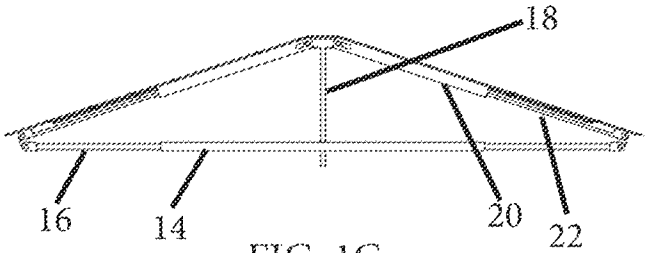
FIG. 1C illustrates an end view of the retractable roof of FIG. 1A.
Figure 2B:
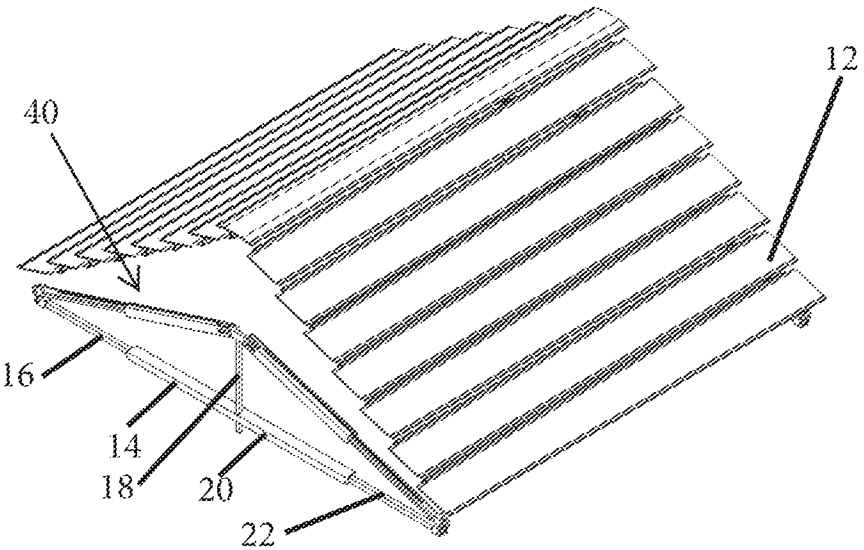
FIG. 2B illustrates an exploded perspective view of the retractable roof of FIG. 1A.
Figure 2D:
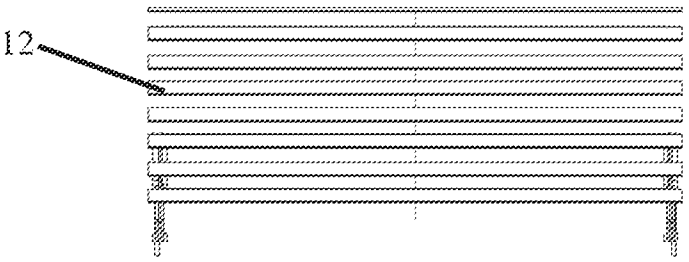
FIG. 2D illustrates an exploded side view of the retractable roof of FIG. 1A.
Figure 2A:
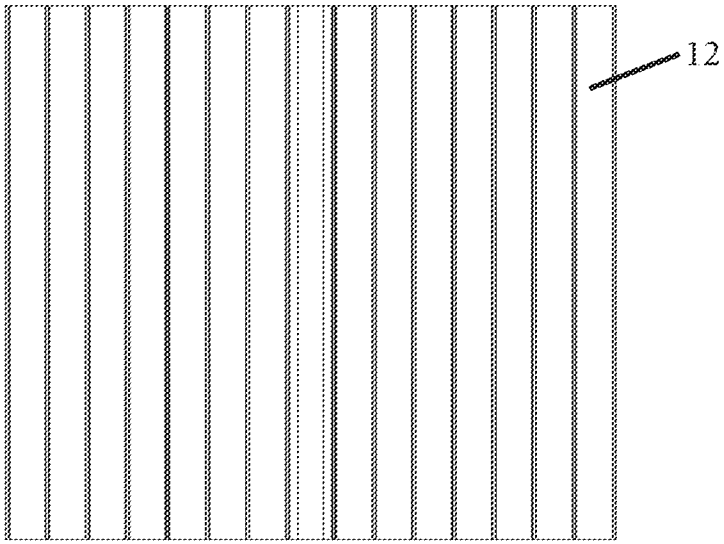
FIG. 2A illustrates an exploded top view of the retractable roof of FIG. 1A.
Figure 2C:
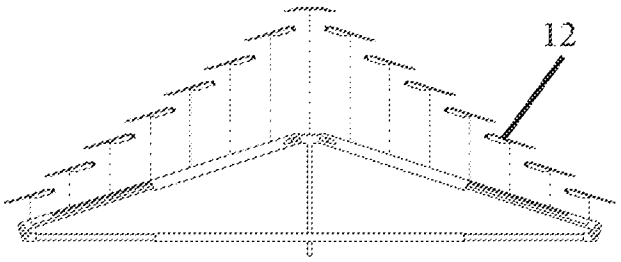
FIG. 2C illustrates an exploded end view of the retractable roof of FIG. 1A.
Figure 3B:
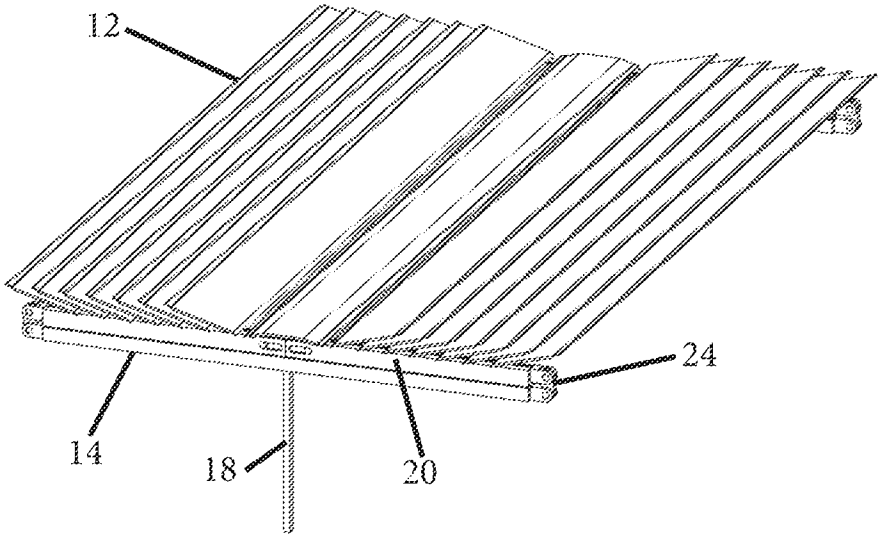
FIG. 3B illustrates a perspective view of the collapsed retractable roof of FIG. 3A.
Figure 3D:
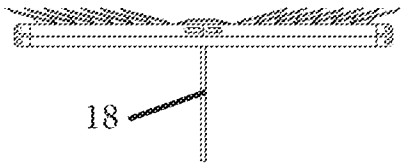
FIG. 3D illustrates a side view of the collapsed retractable roof of FIG. 3A.
Figure 3A:
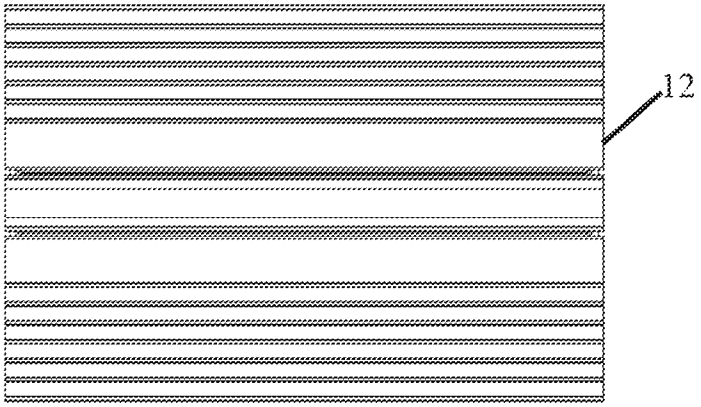
FIG. 3A illustrates a top view of the retractable roof of FIG. 1A in a collapsed configuration.
Figure 3C:
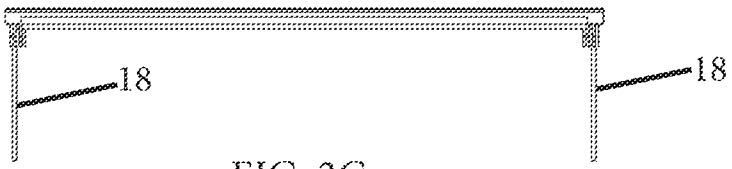
FIG. 3C illustrates an end view of the collapsed retractable roof of FIG. 3A.
Figure 4B:
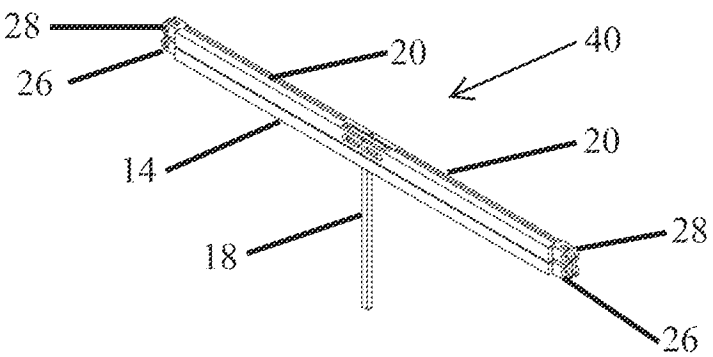
FIG. 4B illustrates a perspective view of the roof frame, in a retracted configuration, of the retractable roof of FIG. 1A.
Figure 4D:
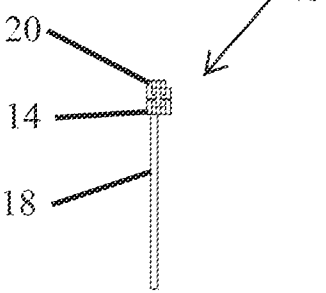
FIG. 4D illustrates a side view of the roof frame, in a retracted configuration, of the retractable roof of FIG. 1A.
Figure 4A:
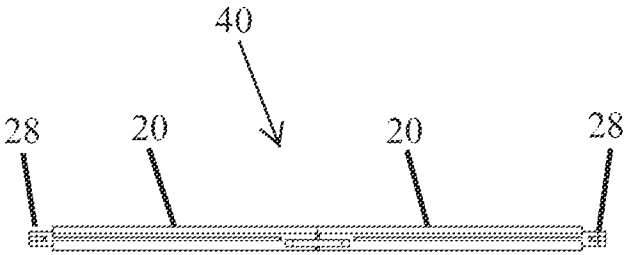
FIG. 4A illustrates a top view of the roof frame, in a retracted configuration, of the retractable roof of FIG. 1A.
Figure 4C:
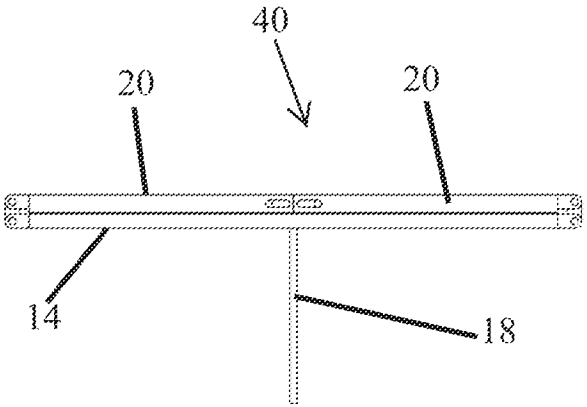
FIG. 4C illustrates an end view of the roof frame, in a retracted configuration, of the retractable roof of FIG. 1A.
Figure 5B:
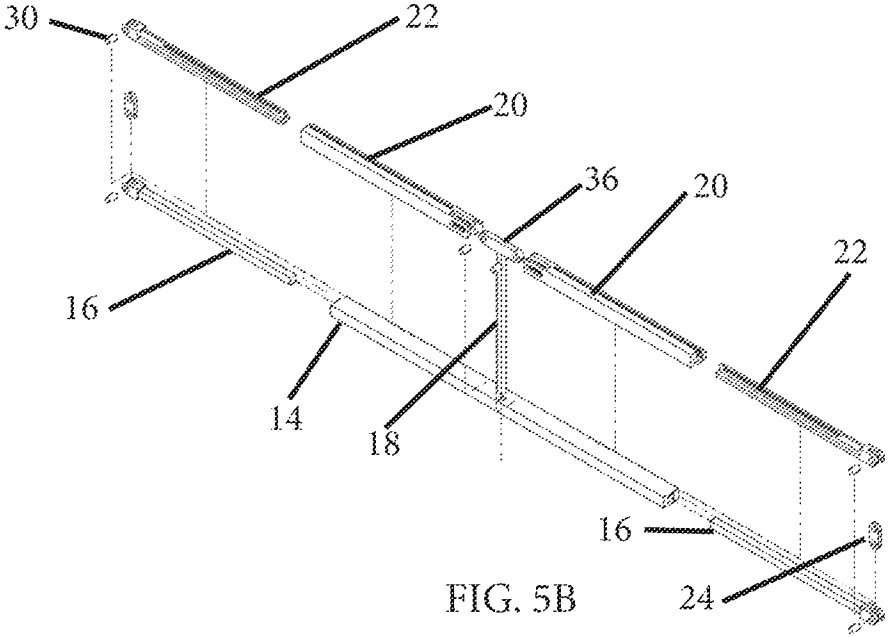
FIG. 5B illustrates an exploded perspective view of the roof frame, in a retracted configuration, of the retractable roof of FIG. 1A.
Figure 5D:
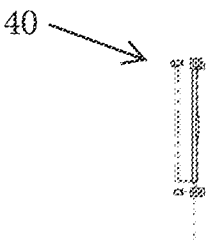
FIG. 5D illustrates an exploded side view of the roof frame, in a retracted configuration, of the retractable roof of FIG. 1A.
Figure 5A:
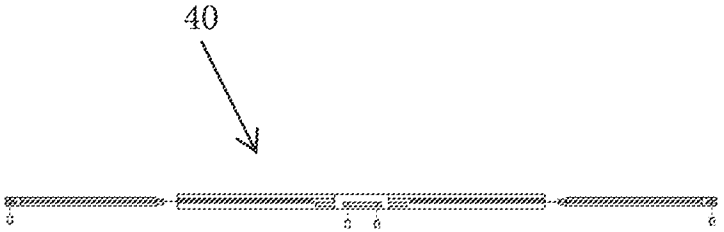
FIG. 5A illustrates an exploded top view of the roof frame, in a retracted configuration, of the retractable roof of FIG. 1A.
Figure 5C:
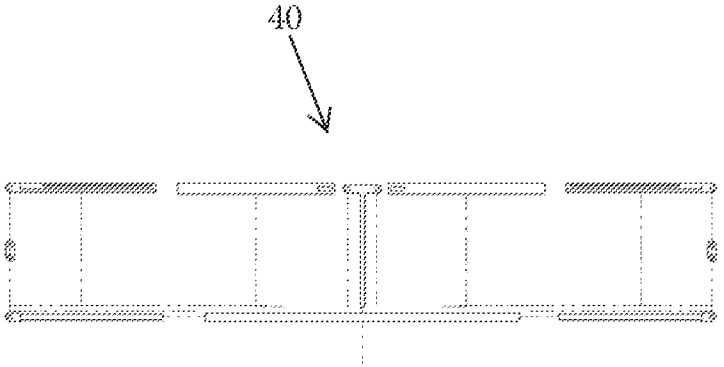
FIG. 5C illustrates an exploded end view of the roof frame, in a retracted configuration, of the retractable roof of FIG. 1A.
Figure 6B:
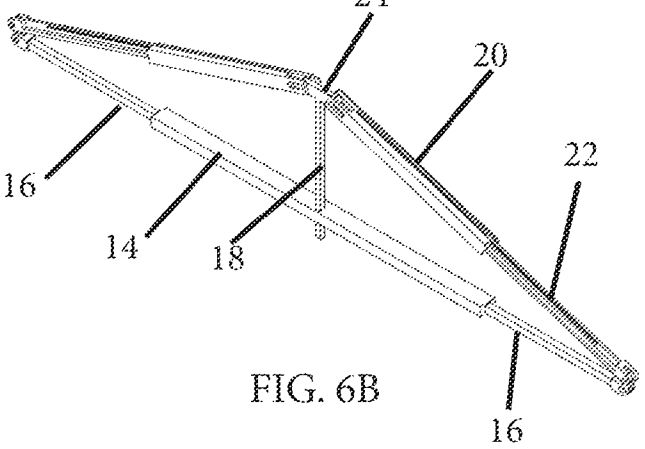
FIG. 6B illustrates a perspective view of the roof frame, in an expanded configuration, of the retractable roof of FIG. 1A.
Figure 6D:
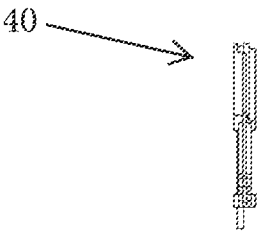
FIG. 6D illustrates a side view of the roof frame, in an expanded configuration, of the retractable roof of FIG. 1A.
Figure 6A:
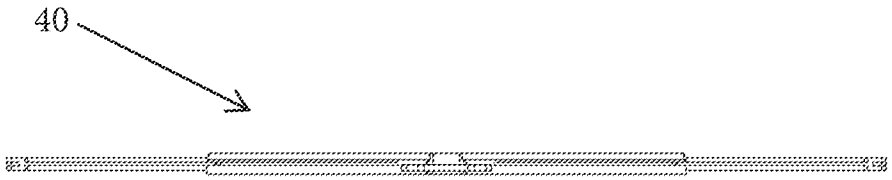
FIG. 6A illustrates a top view of the roof frame, in an expanded configuration, of the retractable roof of FIG. 1A.
Figure 6C:
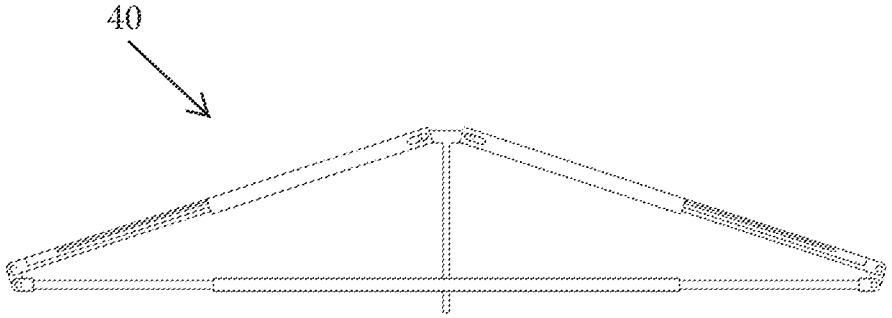
FIG. 6C illustrates an end view of the roof frame, in an expanded configuration, of the retractable roof of FIG. 1A.
Figure 7A:
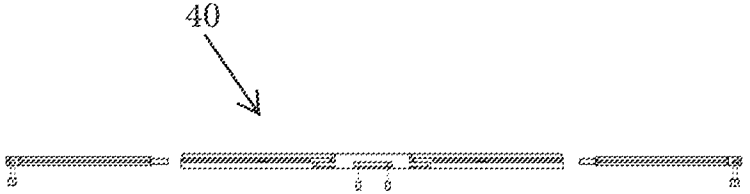
FIG. 7A illustrates an exploded top view of the roof frame, in an expanded configuration, of the retractable roof of FIG. 1A.
Figure 7B:
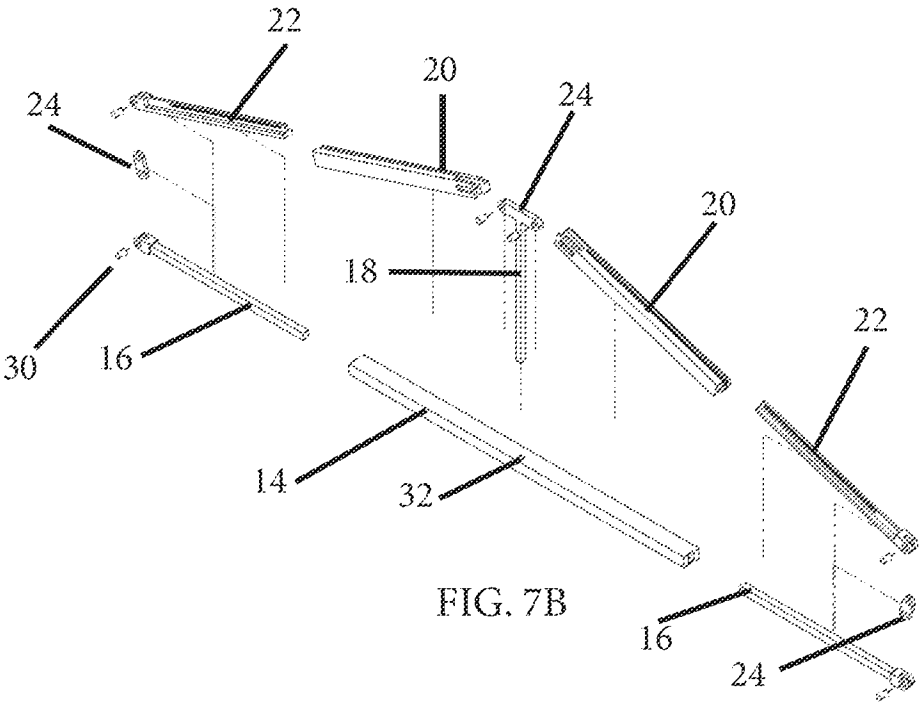
FIG. 7B illustrates an exploded perspective view of the roof frame, in an expanded configuration, of the retractable roof of FIG. 1A.
Figure 7C:
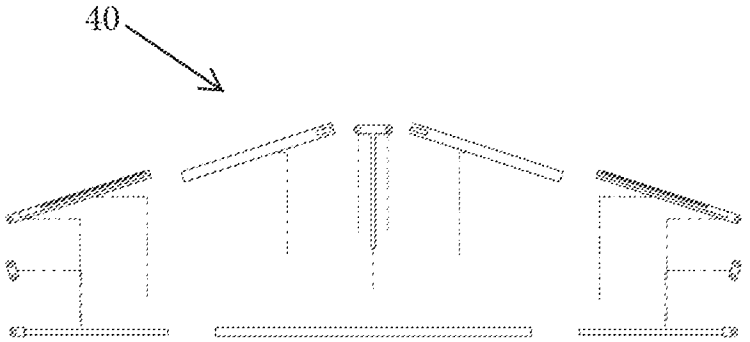
FIG. 7C illustrates an exploded end view of the roof frame, in an expanded configuration, of the retractable roof of FIG. 1A.
Figure 7D:
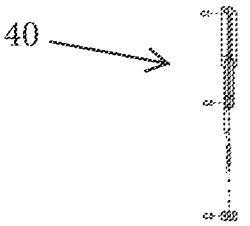
FIG. 7D illustrates an exploded side view of the roof frame, in an expanded configuration, of the retractable roof of FIG. 1A.

FIGS. 3A through 3D illustrate the collapsed configuration for the retractable roof 10. In this configuration, the telescoping members 16 are inserted into the horizontal arm 14 and the telescoping members 22 are inserted into the angled arms 20. The roof boards 12 may be compressed and disposed at an angle more vertical as compared to the expanded configuration of FIGS. 1A through 2D. In the collapsed configuration, the width of the retractable roof 10 is about half of the extended configuration. This will allow it to fit into compacted containers without difficulty. The whole expanding process can be automated since the horizontal beams can be powered by electric motors and the middle vertical riser 18 can be a hydraulic rod. When the frames 40 are extending outward, the outmost boards can be connected to the telescoping members 22, so they are dragged out with the as the telescoping members 22 are extended. The roof boards 12 can be connected to neighboring boards by strings (not shown) that have the same length as the boards' width at the bottom of the boards. This allows all boards to be dragged out with the outermost boards. When the frames 40 are fully extended, all the roof boards 12 should be at the correct location to be fitted without any problem, which is shown in FIG. 1A.

Referring to FIGS. 4A through 5D, the frames 40 are shown in the collapsed configuration. The frame 40 is very compact in this state. The center vertical riser 18 can be combined with the lower roof frame (not shown), or it can be made into an extendable hydraulic beam that makes it much shorter when retracted. The top 36 of the vertical riser 18 can include two pivot connections for the angled arms 20 to pivotably connect thereto. The telescoping arms 22 that extend from the angled arms 20 can pivotably connect to the telescoping arms 16 of the horizontal arm 14 with a double pivot connector 24. For example, the double pivot connector 24 can be a flat plate with two holes formed therethrough. Pins 30 can extend through the holes of the double pivot connector 24 and into the pivot end 28 of the telescoping member 22 and the pivot end 26 of the telescoping member 16. This exemplary construction can best be seen in FIGS. 5B and 5C, for example.

In the collapsed configuration, the angled arms 20 (as well as the telescoping members 22) are disposed alongside the horizontal arm 14. In some embodiments, because of the double pivot connector 24, the angled arms 20 can rest parallel to the horizontal arm 14.

Referring to FIGS. 6A through 7D, the frames 40 are shown in an expanded configuration. In this configuration, the angled arms 20 are disposed at an angle relative to the horizontal arm 14. The horizontal arm 14 can be slid down the vertical riser 18 to form the expanded configuration from the collapsed configuration described above. The angle of the angled arms 20 relative to the horizontal arm 14 can vary, depending on the length of the vertical riser 18 and the desired pitch of the roof.

The frames 40 can be expanded by moving the horizontal arm 14 down the vertical riser 18. The telescoping arms 16, 22 can be extended for the width of the structure on which the roof is disposed.

While in the embodiments illustrated, there is one frame 40 on each end of the retractable roof 10, in some embodiments, especially for longer roof structures, the retractable roof can include one or more central frames. The central frames may be similar to the frames 40 described herein, but may have slots on both sides so that the roof boards can attach to both sides of the central frame.

Referring now to FIGS. 8A through 10E, there are two types of roof boards 12 that are fitted on the retractable roof 10. One of the roof boards 12A has a longer shaft, as described below, and the other roof board 12B has a shorter shaft.

The shorter shaft roof board 12B can attach its rollers 44 to the angled arms 20. The angled arms 20 can include a slot 50 that communicates with a channel that has a width wider than the slot. The rollers 44 can fit into the channel while the shaft extends out of the slot 50, thus preventing the roller 44 from exiting the slot 50 in a direction that is parallel with the axis of the shaft. Similarly, the longer shaft 42 roof board 12A can attach its rollers 44 to the telescoping arms 22 that extend from the angled arms 20. A slot 52 in the telescoping arms 22 (of respective frames 40) can have a wider separation as compared to the slots 50 of the angled arms 20 (of respective frames 40). Thus, the longer shaft 42 can permit the rollers 44 of the roof boards 12A to fit into the telescoping arms 22 while the rollers 44 of the roof boards 12B fit into the angled arms 20. The rollers 44 may include ball bearings or similar structures to permit free movement of the rollers 44 within the slots 50, 52 and associated channels.

The angled arm 20 can include a shelf 54 and the telescoping arms 22 can include a shelf 56. The shelves 54, 56 can support the side overhangs 45 of the roof boards 12 as described above, while the rollers 44 are disposed in the slots 50, 52. The shelves 54, 56 of one of the frames 40 can be directed toward the other of the frames 40 of the retractable roof 10. Thus, the shelves 54, 56 provide a region of reduced spacing between opposing frames 40 for supporting the roof boards 12.

As shown in FIGS. 13A through 13D, the horizontal arm 14 can include a hole 32 that permits the horizontal arm 14 to slide along the vertical riser 18. The hole 32 may be centrally located along a length of the horizontal arm 14. In some embodiments, the horizontal arm 14 can be fixed to the vertical riser 18 and the horizontal arm 14 may be allowed to extend and retract by various means, such as electric, hydraulic or the like.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A retractable roof comprising:

a first frame on a first side of the retractable roof;

a second frame on the second side of the retractable roof;

a plurality of roof boards spanning between the first frame and the second frame;

wherein the first and second frames include:

a vertical riser having a top end and a lower end;

opposing first and second angled arms pivotably extending from opposite sides of the top end of the vertical riser;

a horizontal arm slidably disposed on the vertical riser;

horizontal telescoping arms extendable from opposite ends of the horizontal arm, the horizontal telescoping arms extendable to span at least a width of a structure on which the retractable roof is applied; and telescoping arms extending from each of the first and second angled arms, the telescoping arms pivotably attached to respective ends of the horizontal telescoping arms, wherein the horizontal arm is movable from a first position defining a collapsed configuration and a second position defining an extended configuration, wherein, in the first position, the horizontal arm is disposed closer to both of the first and second angled arms;

the first and second angled arms include a slot directing travel of each of the plurality of roof boards therealong; and each of the plurality of roof boards include a roller on opposing sides of each of the plurality of roof boards, the roller fitting into the slot.

2. The retractable roof of claim 1, further comprising a double pivot connector connecting the telescoping arms to the respective ends of the horizontal telescoping arms.

3. The retractable roof of claim 2, wherein, in the first position, the horizontal arms are generally parallel to the first and second angled arms.

4. The retractable roof of claim 1, wherein:

the telescoping arms include a telescoping arm slot directing travel of a first portion of the plurality of roof boards; and the angled arms include an angled arm slot directing travel of a second portion of the plurality of roof boards.

5. The retractable roof of claim 4, wherein each of the first and second portions of roof boards include a roller on opposing sides thereof, the roller fitting into one of the telescoping arm slot or the angled arm slot.

6. The retractable roof of claim 5, wherein the rollers of the first portion of the plurality of roof boards are spaced apart on opposite sides thereof a first distance and the rollers of the second portion of the plurality of roof boards are spaced apart on opposite sides thereof a second distance, the first distance being greater than the second distance.

7. The retractable roof of claim 1, wherein each of the plurality of roof boards include a side overhang resting on a shelf disposed on the telescoping arms and the first and second angled arms.

8. The retractable roof of claim 1, wherein each of the plurality of roof boards include a forward overhang that overlaps a portion of an adjacent one of the plurality of roof boards when the retractable roof is in the expanded configuration.

9. A retractable roof comprising:

a first frame on a first side of the retractable roof;

a second frame on the second side of the retractable roof;

a plurality of roof boards spanning between the first frame and the second frame;

wherein the first and second frames include:

a vertical riser having a top end and a lower end;

opposing first and second angled arms pivotably extending from opposite sides of the top end of the vertical riser;

a horizontal arm slidably disposed on the vertical riser;

horizontal telescoping arms extendable from opposite ends of the horizontal arm, the horizontal telescoping arms extendable to span at least a width of a structure on which the retractable roof is applied; and telescoping arms extending from each of the first and second angled arms, the telescoping arms pivotably attached to respective ends of the horizontal telescoping arms, wherein the telescoping arms include a telescoping arm slot directing travel of a first portion of the plurality of roof boards;

the angled arms include an angled arm slot directing travel of a second portion of the plurality of roof boards; and each of the first and second portions of roof boards include a roller on opposing sides thereof, the roller fitting into one of the telescoping arm slot or the angled arm slot.

10. The retractable roof of claim 9, wherein the horizontal arm is movable from a first position defining a collapsed configuration and a second position defining an extended configuration, wherein, in the first position, the horizontal arm is disposed closer to both of the first and second angled arms.

11. The retractable roof of claim 9, further comprising a double pivot connector connecting the telescoping arms to the respective ends of the horizontal telescoping arms.

12. The retractable roof of claim 11, wherein, in the first position, the horizontal arms are generally parallel to the first and second angled arms.

13. The retractable roof of claim 9, wherein the rollers of the first portion of the plurality of roof boards are spaced apart on opposite sides thereof a first distance and the rollers of the second portion of the plurality of roof boards are spaced apart on opposite sides thereof a second distance, the first distance being greater than the second distance.

14. The retractable roof of claim 9, wherein each of the plurality of roof boards include a side overhang resting on a shelf disposed on the telescoping arms and the first and second angled arms.

15. The retractable roof of claim 9, wherein each of the plurality of roof boards include a forward overhang that overlaps a portion of an adjacent one of the plurality of roof boards when the retractable roof is in the expanded configuration.

16. A retractable roof comprising:

a first frame on a first side of the retractable roof;

a second frame on the second side of the retractable roof;

a plurality of roof boards spanning between the first frame and the second frame;

wherein the first and second frames include:

a vertical riser having a top end and a lower end;

opposing first and second angled arms pivotably extending from opposite sides of the top end of the vertical riser;

a horizontal arm slidably disposed on the vertical riser;

horizontal telescoping arms extendable from opposite ends of the horizontal arm, the horizontal telescoping arms extendable to span at least a width of a structure on which the retractable roof is applied;

telescoping arms extending from each of the first and second angled arms, the telescoping arms pivotably attached to respective ends of the horizontal telescoping arms; and a double pivot connector connecting the telescoping arms to the respective ends of the horizontal telescoping arms, wherein the horizontal arm is movable from a first position defining a collapsed configuration and a second position defining an extended configuration, wherein, in the first position, the horizontal arm is disposed closer to both of the first and second angled arms;

in the first position, the horizontal arms are generally parallel to the first and second angled arms;

the telescoping arms include a telescoping arm slot directing travel of a first portion of the plurality of roof boards;

the angled arms include an angled arm slot directing travel of a second portion of the plurality of roof boards;

each of the first and second portions of roof boards include a roller on opposing sides thereof, the roller fitting into one of the telescoping arm slot or the angled arm slot; and the rollers of the first portion of the plurality of roof boards are spaced apart on opposite sides thereof a first distance and the rollers of the second portion of the plurality of roof boards are spaced apart on opposite sides thereof a second distance, the first distance being greater than the second distance.

17. The retractable roof of claim 16, wherein:

each of the plurality of roof boards include a side overhang resting on a shelf disposed on the telescoping arms and the first and second angled arms; and each of the plurality of roof boards include a forward overhang that overlaps a portion of an adjacent one of the plurality of roof boards when the retractable roof is in the expanded configuration.

* * * * *